US010691078B2

(12) United States Patent
Yokoo et al.

(10) Patent No.: US 10,691,078 B2
(45) Date of Patent: Jun. 23, 2020

(54) ELECTRONIC DEVICE AND TIMEPIECE

(71) Applicant: CASIO COMPUTER CO., LTD., Shibuya-ku, Tokyo (JP)

(72) Inventors: Kazumasa Yokoo, Higashiyamato (JP); Makoto Sawada, Nishitokyo (JP); Yuta Saito, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 213 days.

(21) Appl. No.: 15/895,506

(22) Filed: Feb. 13, 2018

(65) Prior Publication Data

US 2018/0246476 A1 Aug. 30, 2018

(30) Foreign Application Priority Data

Feb. 27, 2017 (JP) ..... 2017-034287

(51) Int. Cl.

| | |
|---|---|
| ***G04R 60/12*** | (2013.01) |
| ***G04G 17/04*** | (2006.01) |
| ***G04C 9/00*** | (2006.01) |
| ***G04R 20/08*** | (2013.01) |
| ***G04C 9/08*** | (2006.01) |
| ***G04G 17/08*** | (2006.01) |
| ***G04R 20/04*** | (2013.01) |

(Continued)

(52) U.S. Cl.

CPC ..... *G04R 60/12* (2013.01); *G04C 3/146* (2013.01); *G04C 9/02* (2013.01); *G04C 9/08* (2013.01); *G04G 17/04* (2013.01); *G04G 17/045* (2013.01); *G04G 17/08* (2013.01); *G04R 20/02* (2013.01); *G04R 20/04* (2013.01); *G04R 20/08* (2013.01); *G04R 60/14* (2013.01); *G04G 7/02* (2013.01)

(58) Field of Classification Search

CPC ..... G04R 60/12; G04R 20/02; G04R 20/04; G04R 20/08; G04R 60/14; G04R 60/00; G04C 3/146; G04C 9/02; G04C 9/08; G04G 17/04; G04G 17/045; G04G 17/08; G04G 7/02; G04G 21/04; G04B 43/00

USPC ..... 368/47

See application file for complete search history.

(56) References Cited

U.S. PATENT DOCUMENTS 6,853,605 B2 * 2/2005 Fujisawa ..... G04B 37/0008 235/487
6,934,222 B2 * 8/2005 Fujimori ..... G04C 10/00 368/204

(Continued)

FOREIGN PATENT DOCUMENTS

CN 101405665 A 4/2009
CN 104932246 A 9/2015

(Continued)

OTHER PUBLICATIONS

Japanese Office Action (and English language translation thereof) dated Jan. 15, 2019 issued in counterpart Japanese Application No. 2017-034287.

(Continued)

*Primary Examiner* — Edwin A. Leon
(74) *Attorney, Agent, or Firm* — Holtz, Holtz & Volek PC

(57) ABSTRACT

An electronic device and time piece are shown. The electronic device includes: a plurality of antenna devices; a plurality of motors; and antimagnetic plates, each fully or partially covering the motors and having cutouts at positions overlapping with the antenna devices.

20 Claims, 8 Drawing Sheets

(51) Int. Cl.

| | |
|---|---|
| ***G04C 3/14*** | (2006.01) |
| ***G04R 20/02*** | (2013.01) |
| ***G04R 60/14*** | (2013.01) |
| *G04G 7/00* | (2006.01) |

(56) References Cited

U.S. PATENT DOCUMENTS

| | | | | |
|---|---|---|---|---|
| 7,158,449 | B2 * | 1/2007 | Fujimori | G04C 3/008 368/160 |
| 7,697,377 | B2 * | 4/2010 | Agesawa | G04G 99/00 368/156 |
| 8,059,053 | B2 | 11/2011 | Miyazaki et al. | |
| 8,467,272 | B2 | 6/2013 | Fujisawa | |
| 8,570,840 | B2 | 10/2013 | Fujisawa | |
| 8,755,253 | B2 | 6/2014 | Fujisawa | |
| 8,942,068 | B2 | 1/2015 | Fujisawa | |
| 9,116,512 | B2 | 8/2015 | Fujisawa | |
| 9,285,781 | B2 | 3/2016 | Fujisawa | |
| 9,411,315 | B2 | 8/2016 | Sawada | |
| 9,513,605 | B2 | 12/2016 | Fujisawa | |
| 9,720,385 | B2 | 8/2017 | Fujisawa | |
| 2006/0126438 | A1 * | 6/2006 | Itou | G04G 17/08 368/47 |
| 2009/0207083 | A1 | 8/2009 | Miyazaki et al. | |
| 2015/0268636 | A1 | 9/2015 | Sawada | |
| 2017/0293268 | A1 | 10/2017 | Fujisawa | |

FOREIGN PATENT DOCUMENTS

| | | | |
|---|---|---|---|
| JP | 2005084037 | A | 3/2005 |
| JP | 2007232680 | A | 9/2007 |
| JP | 2011075541 | A | 4/2011 |
| JP | 2014062846 | A | 4/2014 |
| WO | 2007108502 | A1 | 9/2007 |

OTHER PUBLICATIONS

Chinese Office Action dated Sep. 26, 2019 (and English translation thereof) issued in Chinese Application No. 201810159503.1.

* cited by examiner

ELECTRONIC DEVICE AND TIMEPIECE

CROSS-REFERENCE TO RELATED APPLICATIONS

This application is based upon and claims the benefit of priority from Japanese Patent Application No. 2017-034287 filed on Feb. 27, 2017 the entire contents of which are incorporated herein by reference.

BACKGROUND OF THE INVENTION

1. Field of the Invention

The present invention relates to electronic devices and timepieces.

2. Description of the Related Art

A traditional electronic device such as a timepiece is equipped with a motor, such as a stepping motor, and an antenna device to receive radio waves.

To enhance the antimagnetic performance of the timepiece and maintain the operating accuracy of the motor, an antimagnetic plate should be installed to magnetically shield the motor from an external magnetic field, which adversely affects the operation of the motor.

Unfortunately, the antimagnetic plate, which causes distortion of the magnetic field, also leads to distortion of radio waves (a magnetic field) entering the antenna device. The antimagnetic plate placed in the vicinity of the antenna device attenuates the radio waves entering the antenna device, resulting in a reduction in radio wave receiving sensitivity of the antenna device.

To cope with this problem, Japanese Unexamined Patent Application Publication No. 2011-075541 discloses a timepiece that includes a microstrip antenna accommodated in and separated from a metallic case. This configuration can successfully prevent a reduction in receiving sensitivity, regardless of the metallic case reducing the receiving sensitivity.

Similarly, in providing an antimagnetic plate, it is possible to consider separating the antenna device from the antimagnetic plate.

Unfortunately, if a small device, such as a wristwatch, is equipped with an electronic device, all the components should be accommodated in limited spaces in a case, which indicates that a motor and an antenna device are inevitably installed in close proximity.

Recently, there has been an increasing demand for implementing multiple antenna devices to process various radio waves and multiple motors to achieve various functions.

Such a trend makes it more difficult to implement antenna devices separate from metal members, as described in Japanese Unexamined Patent Application Publication No 2011-075541, since a required implementation space cannot be provided.

Implementation of a largest possible antimagnetic plate is preferred to enhance antimagnetic performance and thereby maintain the operating accuracy of the motors. However, implementation of multiple antenna devices precludes securement of a space for implementing a large antimagnetic plate without close proximity between the motors and the antenna devices.

For an electronic device, which receives radio waves to correct the time and determine the position, a reduction in receiving sensitivity of antenna devices leads to a reduction in performance of the electronic device.

Because of this, the electronic device has been forced to sacrifice the antimagnetic performance of the motors to some extent to maintain the radio wave receiving performance of the antenna devices.

SUMMARY OF THE INVENTION

The present invention provides an electronic device and timepiece provided with a plurality of motors and a plurality of antenna devices which are able to maintain accuracy of operation of the motor by enhancing antimagnetic performance and able to maintain radio wave receiving performance of the antenna devices.

According to an aspect of the present invention, an electronic device includes: a plurality of antenna devices; a plurality of motors; and antimagnetic plates, each fully or partially covering the motors and having cutouts at positions overlapping with the antenna devices.

DESCRIPTION OF THE PREFERRED EMBODIMENTS

With reference to FIGS. 1 to 15, an electronic device according to the present invention and a timepiece accommodating it will now be described.

Although the embodiments described below have various preferred technical restrictions to implement the present invention, these embodiments and drawings, however, should not be construed to limit the scope of the invention.

Figure 1:
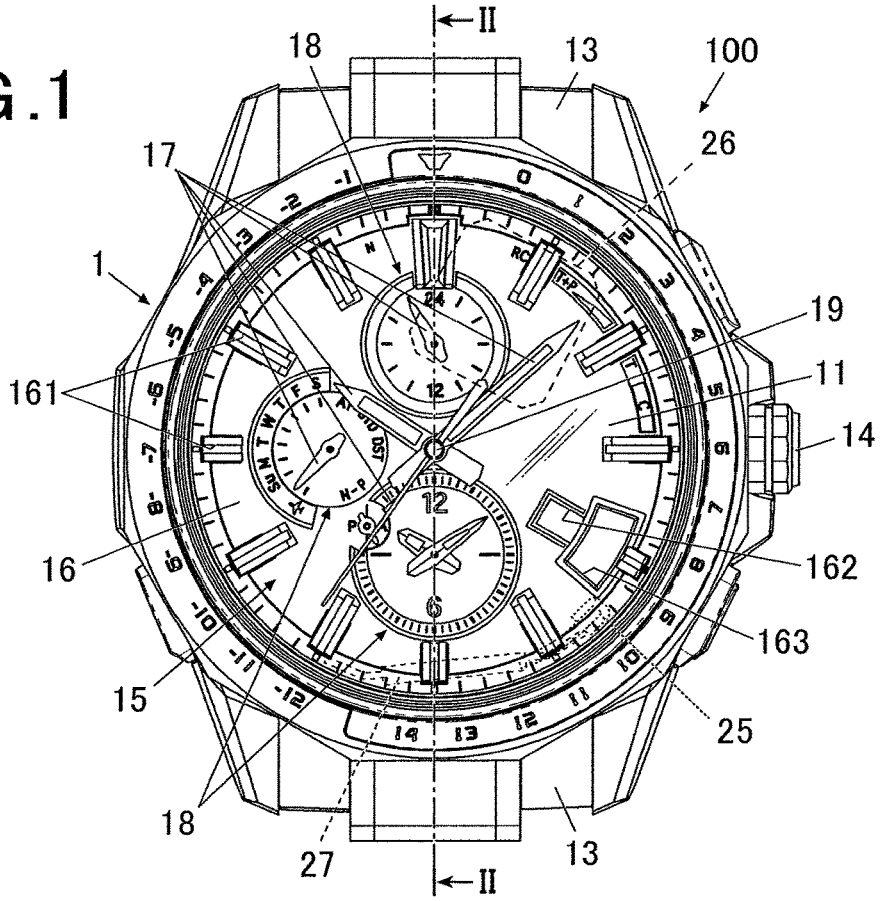
FIG. 1 is a front view of a timepiece according to an embodiment of the present invention.
Figure 2:
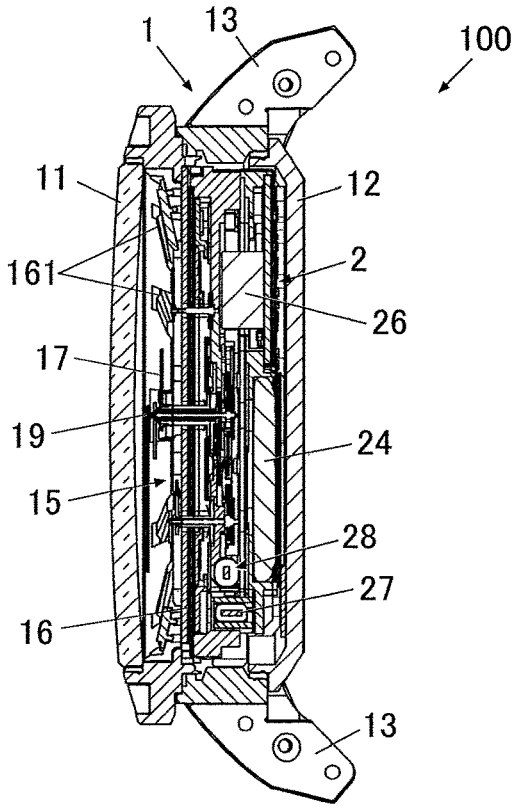
FIG. 2 is a cross-sectional view of the timepiece taken along line II-II of FIG. 1.

FIG. 1 is a front view of the timepiece according to an embodiment of the present invention. FIG. 2 is a cross-sectional view of the timepiece taken along line II-II of FIG. 1.

As shown in FIG. 1, a timepiece 100 according to this embodiment includes a case (hereinafter referred to as a "timepiece case 1" according to this embodiment). The timepiece case 1 is composed of metal, such as stainless steel and titanium, ceramic, or a synthetic resin. Alternatively, the timepiece case 1 may be composed of any other material.

The timepiece case 1 according to this embodiment is a short hollow column and provided with a wind shield 11 composed of transparent glass on the front (viewer side) of the timepiece 100.

The timepiece 100 has a rear lid 12 on its rear face.

The timepiece case 1 includes band mounts 13 for mounting a timepiece band (not shown) at its upper and lower ends, i.e., at the 12 o'clock and 6 o'clock positions of an analog timepiece, as shown in FIG. 1.

The timepiece 100 includes an operational button 14 on a side of the timepiece case 1.

The operational button 14 is connected to a module 2 (described below), which has its insertion end located inside the timepiece case 1. The operational button 14 according to this embodiment is, for example, a winder that allows various operations to be performed by pressing or rotating the operational button 14.

The timepiece case 1 accommodates the electronic device including module 2 and a display 15. The display 15 is driven by motors 28 provided in the module 2 to operate and display the time.

The timepiece 100 according to this embodiment includes a functional wheel 52 (see FIG. 10) as a rotor (described below). The electronic device includes the module 2 and the functional wheel 52.

As shown in FIGS. 1 and 2, the display 15 is provided below the wind shield 11 in the timepiece case 1.

The display 15 according to this embodiment is an analog display which includes a dial plate 16 and pointers 17 thereabove, as shown in FIG. 1. The pointers 17 includes hour, minute, and second hands and functional hands.

Hourmarks 161 are disposed on the surface of the dial plate 16 around its perimeter to show the time indicated by the pointers 17 (the hour, minute, and second hands).

The timepiece 100 according to this embodiment includes a calendar wheel 51 and a functional wheel 52, as described below. The calendar wheel 51 is a rotor with date numbers disposed around its periphery, while the functional wheel 52 is a rotor with worldwide city names disposed around its periphery (see FIG. 9). A window 162 and a window 163 are provided near the outer periphery of the dial plate 16 at the 4 o'clock position of an analog timepiece. The window 162 exposes a date on the calendar wheel 51 to the viewer side, while the window 163 exposes function-related information, such as a city name, on the functional wheel 52 to the viewer side. It should be noted that the windows 162 and 163 may be disposed at any position other than those shown in the drawing.

Besides the main display that displays the time with the pointers 17 of the hour, minute, and second hands, a small display 18 equipped with the pointer 17 of the functional hand is provided in the display 15.

The small display 18 displays the time at a city or region (for example, the current time in New York) which is different from that displayed with the hour, minute, and second hands (for example, the current time in Tokyo if the timepiece 100 is used there).

Alternatively, the display 15 need not be equipped with the small display 18. Alternatively, the display 15 may be a digital display that includes a liquid crystal panel or may include both of an analog display with the pointers 17 and a digital display that includes a liquid crystal panel.

The module 2 includes, for example, several antenna devices for receiving radio waves (in this embodiment, a BLE antenna 25, a GPS antenna 26, and a standard radio wave antenna 27, described below, see FIGS. 4A and 4B), a timepiece movement which includes the motors 28 for operating the pointers 17 and a train wheel mechanism 29 (see FIGS. 4A and 4B), substrates with various electronic components implemented thereon (an upper substrate 22 and a lower substrate 23, see FIG. 3), and a battery 24 (see FIG. 3) to supply power to functional units in the timepiece 100.

Coaxial pointer shafts 19 extend from the module 2 through the dial plate 16 and protrudes from the dial plate 16.

The pointer shafts 19 according to this embodiment are pointer shafts for the hour, minute, and second hands and a pointer shaft for the functional hand. These pointer shafts for the hour, minute, and second hands are coaxially disposed and the pointers 17 of the hour, minute, and second hands are connected to their respective pointer shafts 19.

The pointer shafts 19 rotating in accordance with the timepiece movement causes their respective pointers 17 mounted thereon to separately pivot about their respective pointer shafts 19 above the upper face of the dial plate 16.

The number of the pointer shafts 19 and the number of the pointers 17, which are mounted on and pivot about their respective pointer shafts 19, are not limited to those shown in the drawing. Besides the hour, minute, and second hands, pointers 17 of functional hands which display function-related information may be provided, like this embodiment. Alternatively, a pointer shaft 19 may be provided to support only, for example, the hour hand and a single pointer 17 may be mounted on the pointer shaft 19.

Figure 3:
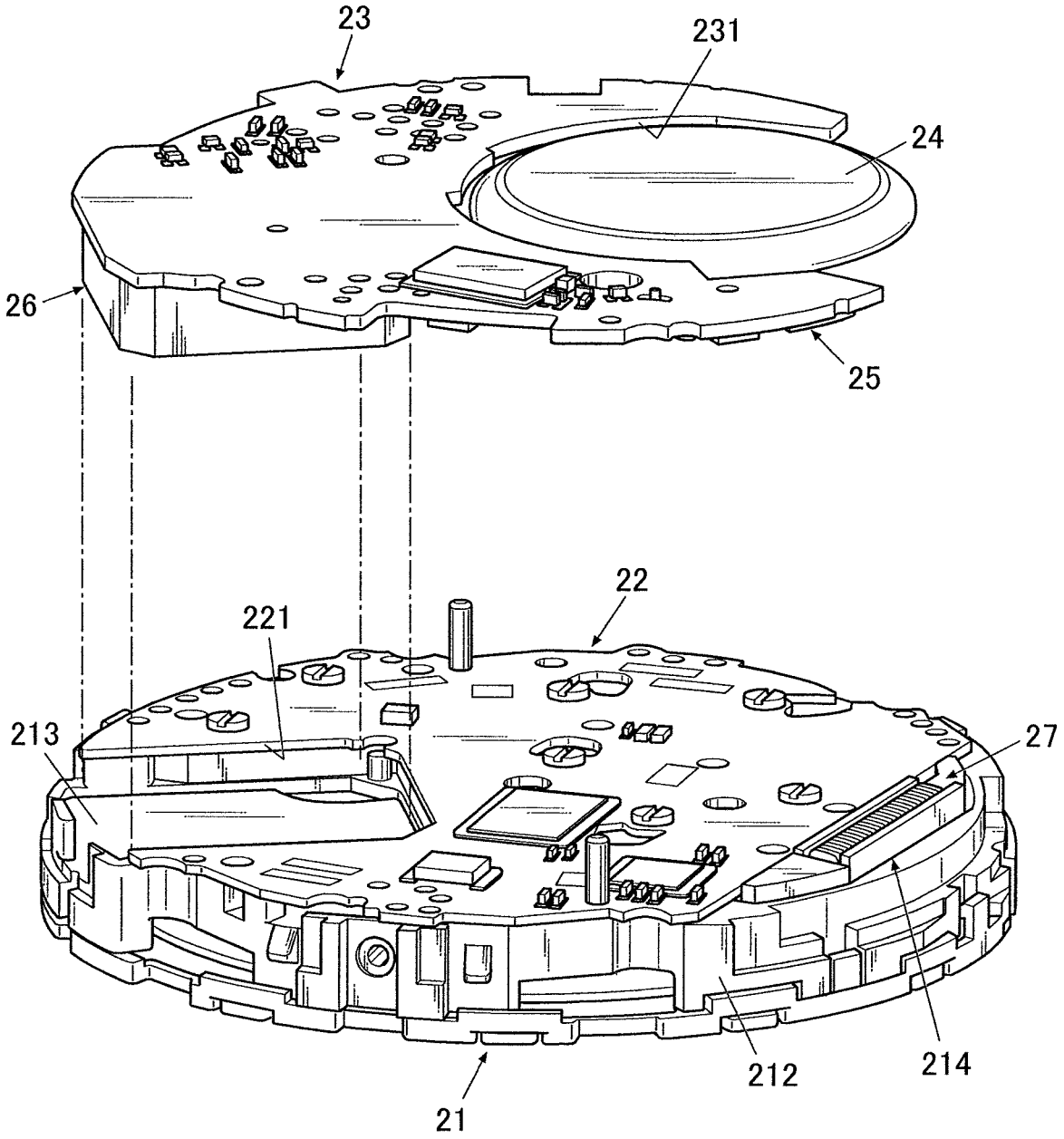
FIG. 3 is an exploded perspective view of substrates and antenna devices disposed in a module.

FIG. 3 is a partially exploded perspective view of the module according to this embodiment, viewed from the opposite (lower) side of the viewer of the timepiece. FIG. 4A is a plan view of the module, viewed from the viewer (upper) side of the timepiece. FIG. 4B is a plan view of the module, viewed from the opposite (lower) side of the viewer of the timepiece.

With reference to FIG. 3, the module 2 according to this embodiment includes a housing 21 and two substrates (the upper substrate 22 and the lower substrate 23) disposed on the lower side of the housing 21, i.e., the opposite side of the viewer of the timepiece 100.

Figure 4A:
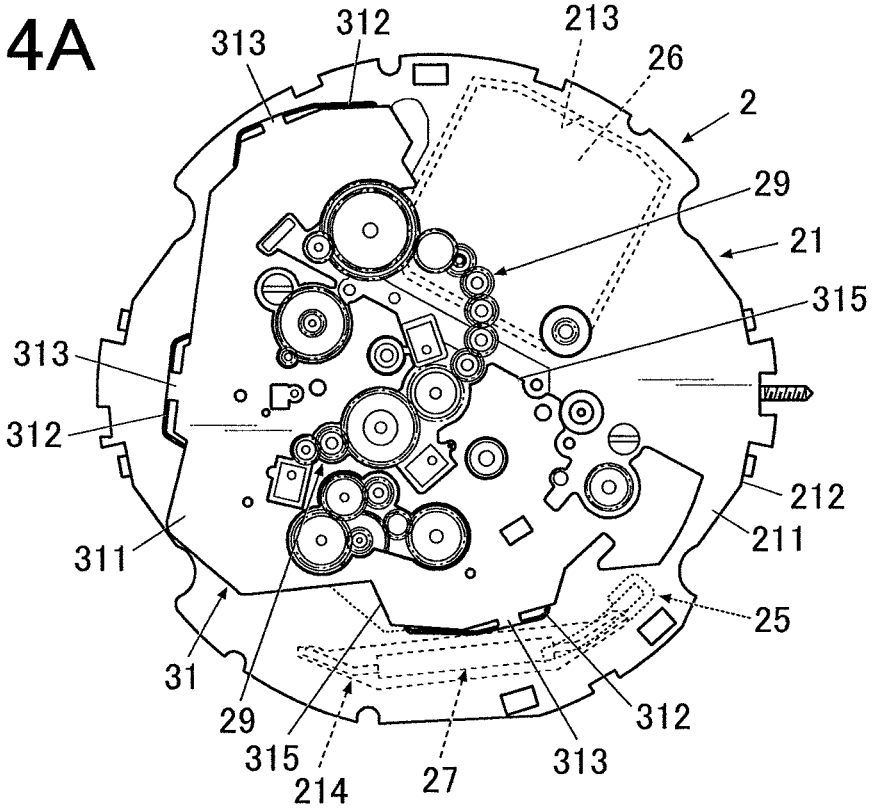
FIG. 4A is a plan view of the module viewed from a viewer side.

With reference to FIG. 4A, three antenna devices (the BLE antenna 25, the GPS antenna 26, and the standard radio wave antenna 27), which are not disposed on the front (viewer side), are illustrated with broken lines for the convenience of illustration. With reference to FIG. 4B, two substrates (the upper substrate 22 and the lower substrate 23) are removed and antenna devices (the BLE antenna 25 and the GPS antenna 26) disposed on the lower substrate 23 are illustrated with two-dot chain lines for the convenience of illustration.

The housing 21 is composed of, for example, resin and includes a base plate 211 and a side wall 212 disposed around its periphery.

The housing 21 provides upper and lower spaces above and below the base plate 211, the height of upper and lower spaces being equal to the raised length of the side wall 212, and accommodates the timepiece movement, various electronic components, and the substrates in the spaces.

The substrate according to this embodiment has a double-layer structure of the upper substrate 22 and the lower substrate 23. The upper substrate 22 and the lower substrate 23 are disposed on the rear side of the base plate 211 in the housing 21 (the opposite (lower) side of the viewer of the timepiece 100).

In detail, the upper substrate (a first substrate) 22 is disposed on the viewer side and the lower substrate (a second substrate) 23 is disposed below the upper substrate 22 (on the opposite side of the viewer of the timepiece 100) such that the upper substrate 22 and the lower substrate 23 are partially superimposed in the thickness direction of the module 2.

FIG. 3 illustrates the module 2 viewed from the opposite (lower) side of the viewer of the timepiece 100, which is a horizontally reversed state of the module 2 viewed from the viewer side.

The lower substrate 23 according to this embodiment has a battery space 231, which is disposed at the 6 o'clock position of an analog timepiece.

The battery space 231 is a cutout conforming with the outer shape of the battery 24 (a button battery in this embodiment, as shown in FIG. 3) and accommodates the battery 24.

The BLE antenna 25 as a first antenna device is disposed on the viewer face of the lower substrate 23, i.e., the face opposing the upper substrate 22, in the vicinity of the battery space 231.

The BLE antenna 25 is a Bluetooth (registered trademark) Low Energy compliant antenna for relatively short-distance radio communication.

The timepiece 100 according to this embodiment sends and receives signals, shares information and performs synchronization with other devices located at a relatively short distance via the BLE antenna 25.

The Global Positioning System (GPS) antenna 26 as a second antenna device is disposed on the viewer (upper) face of the lower substrate 23 (i.e., the face opposing the upper substrate 22) at the opposite position of the battery space 231 and the BLE antenna 25 along the plane direction (i.e., at the 12 o'clock position of an analog timepiece).

The GPS antenna 26 receives signals sent from GPS satellites, for example, positioning codes, such as Coarse and Acquisition (C/A) codes and precise positioning (P) code, and navigation messages, such as Almanac information (summary orbit information) and Ephemeris information (detailed orbit information). The GPS antenna 26 can receive relatively high-frequency signals, for example, in the L1 (1575.42 MHz) and L2 (1227.6 MHz) bands. For example, a microstrip antenna can be suitably used as the GPS antenna 26. To achieve a compact implementation by downsizing the module 2, the GPS antenna 26 should be preferably smallest possible.

The timepiece 100 according to this embodiment determines the three-dimensional geographical position (latitude, longitude, and altitude) of, for example, the timepiece 100 based on the signals received by the GPS antenna 26.

The housing 21, which has the lower substrate 23 mounted on the rear (lower) side of the housing 21 (i.e., the opposite side of the viewer of the timepiece 100), includes a GPS antenna space 213 for accommodating the GPS antenna 26 at a position corresponding to the GPS antenna 26.

The upper substrate 22 has a cutout 221 conforming with the outer shape of the GPS antenna 26 at a position corresponding to the GPS antenna space 213 on the upper substrate 22 mounted on the housing 21.

The GPS antenna space 213 has a thickness substantially identical to that of the GPS antenna 26 (the thickness of the GPS antenna 26 minus the thickness of the upper substrate 22). The GPS antenna 26 is accommodated in the cutout 221 and the GPS antenna space 213 such that the GPS antenna 26 is substantially flush with the rear face of the upper substrate 22 where the lower substrate 23, which has the GPS antenna 26 mounted thereon, is disposed in rear of the housing 21 to oppose the upper substrate 22.

In this embodiment, the battery 24 and the GPS antenna 26 are disposed on the same plane side by side, the GPS antenna 26 is accommodated in the GPS antenna space 213 of the housing 21, and the battery 24 is accommodated in the battery space 231, being a cutout on the lower substrate 23, as shown in FIG. 3. This configuration can eliminate irregularity on the rear face of the housing 21 to the maximum extent possible and reduce useless spaces to achieve a compact implementation.

An antenna retainer 214 is provided on the rear (lower) side of the base plate 211 of the housing 21 (i.e., the opposite side of the viewer of the timepiece 100) at a position that fully or partially overlaps with the BLE antenna 25 disposed on the mounted lower substrate 23. The antenna retainer 214 accommodates the standard radio wave antenna 27 as a third antenna device.

The standard radio wave antenna 27 can receive date and time information sent from an atomic timepiece in a standard radio station in the form of digital signals and is, for example, a coil-wound core composed of amorphous magnetic metal or ferrite.

The timepiece 100 corrects the time based on the digital signals containing date and time information received by the standard radio wave antenna 27.

The upper substrate 22 according to this embodiment has a cutout at a position corresponding to the antenna retainer 214 such that the antenna retainer 214 and the standard radio wave antenna 27 are disposed at a lower level than the upper substrate 22. This configuration, which allows the standard radio wave antenna 27 to be disposed on the rear side of the base plate 211, minimizes the irregularity.

The BLE communication using the BLE antenna 25 is a short-distance radio communication on a 2.4 GHz frequency band and does not interfere with the standard radio wave antenna 27, which is an antenna device to receive standard radio waves with a frequency of 40 kHz and/or 60 kHz.

Because of this nature, the BLE antenna 25 and the standard radio wave antenna 27 among the several antenna devices according to this embodiment are superimposed in the thickness direction of the module 2, i.e., the direction perpendicular to the antimagnetic plates. The BLE antenna 25 and the standard radio wave antenna 27 may be partially superimposed but need not be fully superimposed. The BLE antenna 25 and the standard radio wave antenna 27 may be disposed in any manner other than that shown in the drawing.

The antenna devices superimposed with each other enables compact and efficient implementation of the antenna devices (the BLE antenna 25 and the standard radio wave antenna 27 according to this embodiment) and can reduce the implementation area.

In this embodiment, antimagnetic plates (the front antimagnetic plate 31 shown in FIG. 4A and the rear antimagnetic plate 32 shown in FIG. 4B) are disposed to enhance the antimagnetic performance of the motors 28 (see FIG. 5), as described below. Unfortunately, the antimagnetic plates disposed in the vicinity of the antenna devices cause a reduction in receiving sensitivity of these antenna devices. To cope with this problem, some of the several antenna devices are at least partially superimposed to achieve compact implementation of the antenna devices in a small space and disposition of the antimagnetic plates in a larger area without close proximity with the antenna devices. This configuration expands the area covered by the antimagnetic plates, enhances the antimagnetic performance of the motors 28, and increases the degree of freedom in allocation of the motors 28 and the antimagnetic plates.

The multiple motors 28 (six motors 28*a* to 28*f* in this embodiment, see FIG. 5) are disposed on the surface (upper face) of the base plate 211 of the housing 21, i.e., on the viewer side of the timepiece 100). The expression simply "motors 28" refers to the six motors 28*a* to 28*f*.

Each motor 28 is a stepping motor. The stepping motor includes, for example, a stator 281, a coil block 284, and a rotor 285 which is accommodated in a receptor of the stator 281. The coil block 284 includes a core 282 and a coil 283 wound therearound and is magnetically connected to the stator 281. Driving pulses applied, as appropriate, to the coil block 284 magnetically connected to the stator 281 cause the rotor 285 to rotate at a predetermined step angle.

Figure 5:
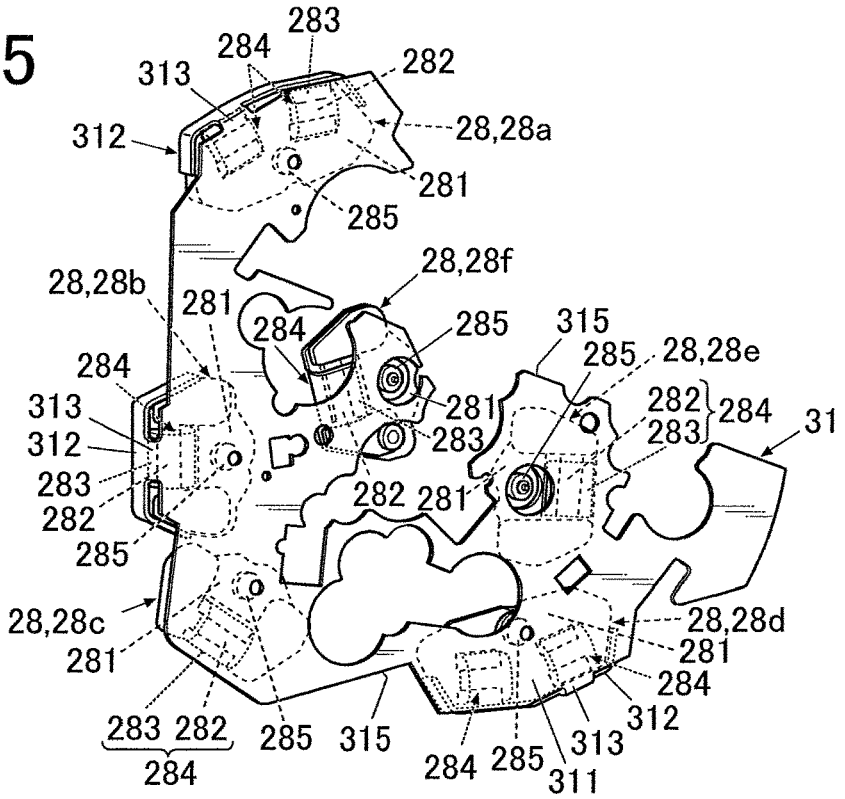
FIG. 5 is a perspective view illustrating a positional relationship between a front antimagnetic plate and motors.

In this embodiment, four motors 28*b*, 28*c*, 28*e*, and 28*f* in FIG. 5 each include a single coil block 284, while two motors 28*a* and 28*d* in FIG. 5 each include two coil blocks 284.

The motors 28 operate each functional unit of the timepiece 100 and constitute a timepiece movement together with the train wheel mechanism 29 including a gear.

Each motor 28 is preferably disposed separately from the three antenna devices of the BLE antenna 25, the GPS antenna 26, and the standard radio wave antenna 27 according to this embodiment to the maximum extent possible.

Figure 4B:
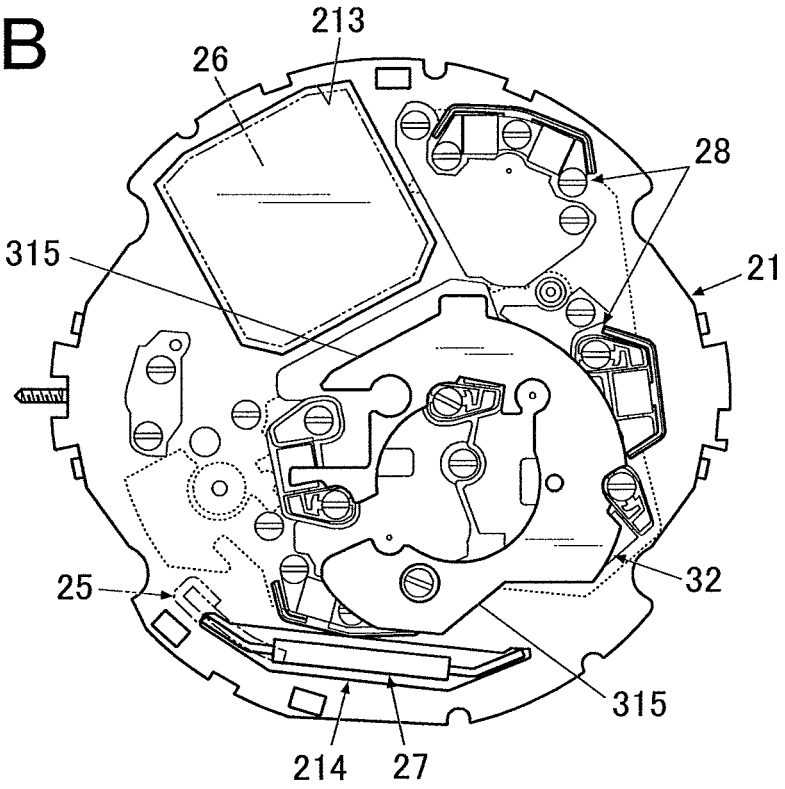
FIG. 4B is a plan view of a housing viewed from the opposite side of the viewer.

The number or allocation of the motors 28 shown in FIG. 4B is exemplary and any number of the motors 28 may be disposed at any positions.

With reference to FIGS. 4A and 4B, the antimagnetic plates are disposed in the front and rear of the base plate 211.

In detail, the front antimagnetic plate 31 is disposed above the base plate 211 on the viewer (front) side of the timepiece 100, as shown in FIG. 4A, while the rear antimagnetic plate 32 is disposed above the base plate 211 on the opposite side of the viewer (rear side) of the timepiece 100, as shown in FIG. 4B.

Figure 6A:
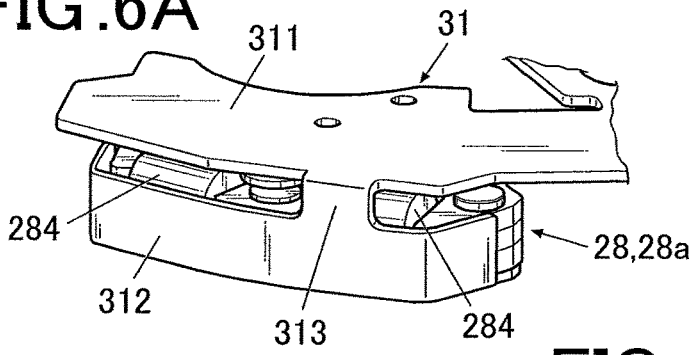
FIG. 6A is a fragmentary perspective view of side covers and motors disposed adjacent thereto.
Figure 6B:
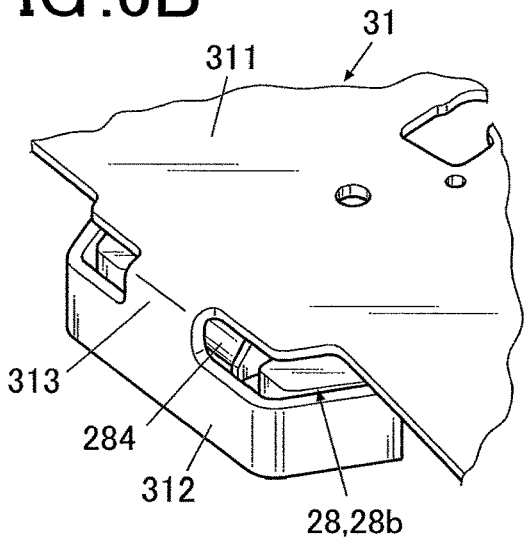
FIG. 6B is another fragmentary perspective view of side covers and motors disposed adjacent thereto.
Figure 6C:
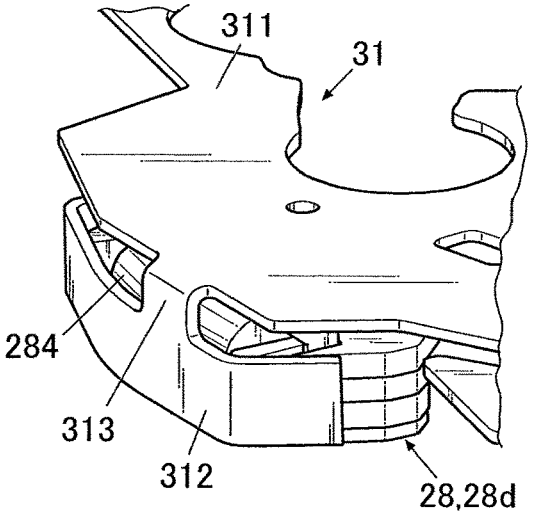
FIG. 6C is another fragmentary perspective view of side covers and motors disposed adjacent thereto.
Figure 7:
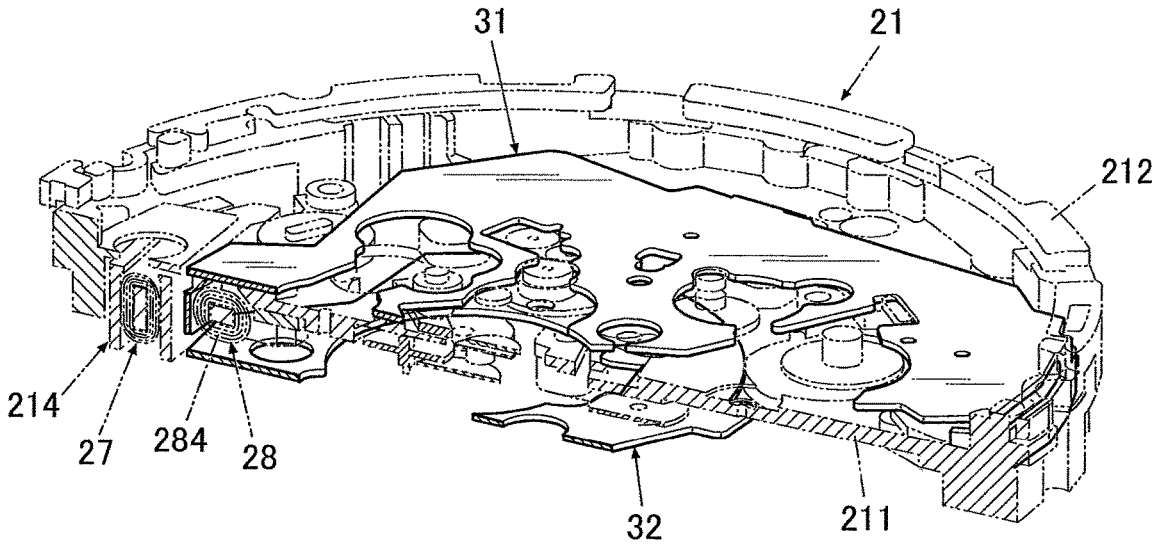
FIG. 7 is a fragmentary cross-sectional view illustrating a positional relationship between a front antimagnetic plate and a rear antimagnetic plate in a housing of the module.
Figure 8:
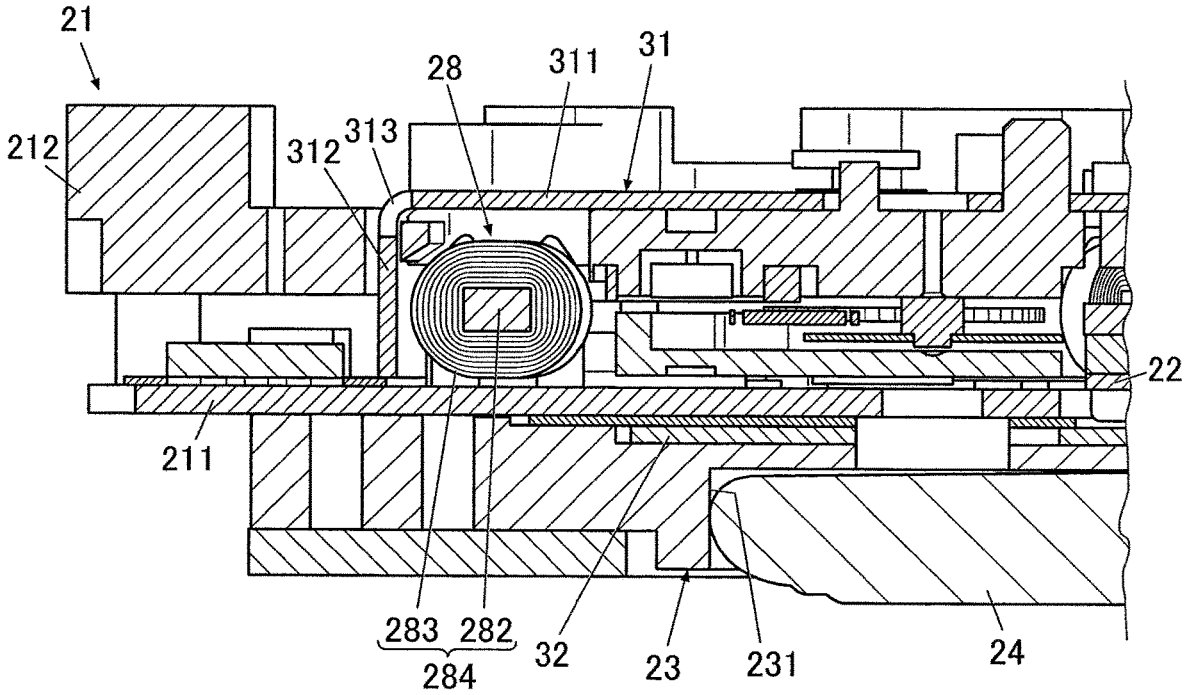
FIG. 8 is a fragmentary cross-sectional view illustrating a positional relationship between a motor and a side cover of the front antimagnetic plate.

FIG. 5 is a perspective view illustrating a positional relationship between the front antimagnetic plate 31 and the motors 28. FIGS. 6A, 6B, and 6C are fragmentary enlarged views of FIG. 5. FIG. 7 is a cross-sectional schematic view of the antimagnetic plates in the housing. FIG. 8 is a fragmentary cross-sectional view illustrating a positional relationship between the front antimagnetic plate 31 and the motors 28.

Each antimagnetic plate fully or partially covers multiple motors 28 and provides a cutout 315 to avoid overlap with the three antenna devices of the BLE antenna 25, the GPS antenna 26, and the standard radio wave antenna 27 according to this embodiment.

In detail, the front antimagnetic plate 31 is disposed above the base plate 211 on the viewer (front) side of the timepiece 100 so as to avoid overlap with the three antenna devices of the BLE antenna 25, the GPS antenna 26, and the standard radio wave antenna 27 according to this embodiment.

With reference to FIG. 7, the antimagnetic plates according to this embodiment consist of the front antimagnetic plate 31 disposed on the viewer side and the rear antimagnetic plate 32 disposed on the opposite side of the viewer. The motors 28 are disposed between the front antimagnetic plate 31 and the rear antimagnetic plate 32, i.e., between the front and rear sides of the timepiece 100.

The antimagnetic plates distort an external magnetic field to prevent it from reaching the motors 28 and have a magnetically shielding effect.

Each antimagnetic plate (the front antimagnetic plate 31 and the rear antimagnetic plate 32) is composed of, for example, cold-reduced carbon steel sheets and strips (SPCC) or permalloy.

Any antimagnetic plate may be used which can effectively prevent a magnetic field, which adversely affects the motors 28, from reaching the motors 28. The antimagnetic plates may be composed of any material other than those described here.

With reference to FIGS. 4A and 5, the front antimagnetic plate 31 according to this embodiment is cut into an anisomerous shape to avoid contact with the antenna devices and the train wheel mechanism 29. The front antimagnetic plate 31 may have any shape other than that shown in the drawing.

The front antimagnetic plate 31 according to this embodiment includes an antimagnetic plate body 311 and a side cover 312. The antimagnetic plate body 311 covers the viewer sides of the motors 28. The side cover 312 is connected to the antimagnetic plate body 311 to cover the sides of the motors 28.

Of the six motors 28*a* to 28*f* according to this embodiment, three motors 28*a*, 28*b*, and 28*d* disposed near the periphery of the module 2 have their sides covered with the side cover 312. The motors 28 having sides covered with the side cover 312 need not be limited to those shown in the drawing. The side cover 312 that can cover, for example, the sides of all the motors 28 may be provided to cover all the sides.

FIG. 6A to 6C are fragmentary perspective views illustrating the side cover 312 covering the motor 28*a* and its side face, the motor 28*b* and its side face, and the motor 28*d* and its side face, respectively.

The front antimagnetic plate 31 according to this embodiment is a single sheet fabricated by stamping a material plate into a predetermined shape and bending the stamped plate. In detail, the side cover 312 is connected to the antimagnetic plate body 311 via a bridge 313, as shown in FIGS. 6A to 6C.

The antimagnetic plate body 311, which covers the viewer sides of the motors 28, is formed integrally with the side cover 312 covering the sides of the motors 28. This configuration allows the front antimagnetic plate 31 to seamlessly cover a larger area than the antimagnetic plate body 311 formed separately from the side cover 312 and disposed around the motors 28, which can achieve a higher antimagnetic effect.

The side cover 312 should be preferably bent near its two ends so as to be disposed along the side faces of each coil block 284.

The bent portions of the side cover 312 should preferably be long enough to at least cover the areas defined by extending the core 282 wound by the coil 283 in the lateral direction.

The side covers 312 in FIGS. 6A to 6C have exemplary shapes. Any other shape is also available.

As described above, the timepiece 100 accommodating the electronic device according to the present invention include the calendar wheel 51 for displaying a date and the functional wheel 52 for displaying function-related information, such as a city name.

The calendar wheel 51 and the functional wheel 52 are each a plate-like toroidal rotor composed of a non-metallic material and rotate along the plane direction when driven by the motors 28.

The non-metallic material of the calendar wheel 51 and the functional wheel 52 is a synthetic resin, for example, acrylic or polycarbonate resin. The calendar wheel 51 and the functional wheel 52 may be composed of any other non-metallic material.

The calendar wheel 51 and the functional wheel 52 may be composed of an identical material or different materials. The calendar wheel 51 and the functional wheel 52 may have any thickness, color and size, which may be determined as appropriate based on the design of the timepiece 100.

Figure 9:
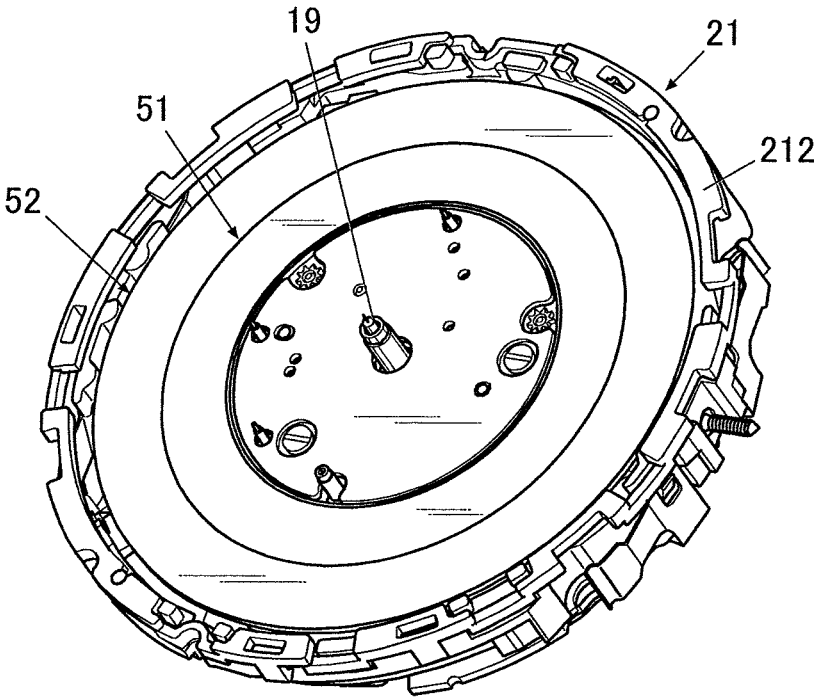
FIG. 9 is a perspective view of the housing of the module provided with a rotor.
Figure 10:
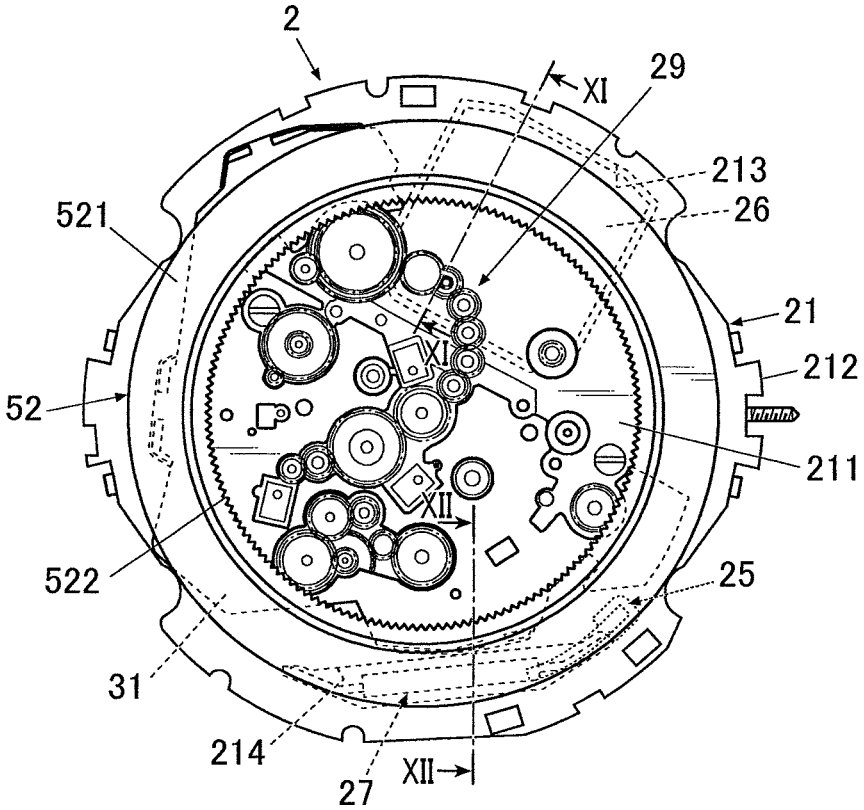
FIG. 10 is a plan view showing a positional relationship between the rotor and antenna devices.

FIG. 9 is a perspective view of the calendar wheel 51 and the functional wheel 52 mounted to the housing 21 of the module 2. FIG. 10 illustrates a positional relationship between the functional wheel 52 and the three antenna devices of the BLE antenna 25, the GPS antenna 26, and the standard radio wave antenna 27 according to this embodiment.

Figure 11:
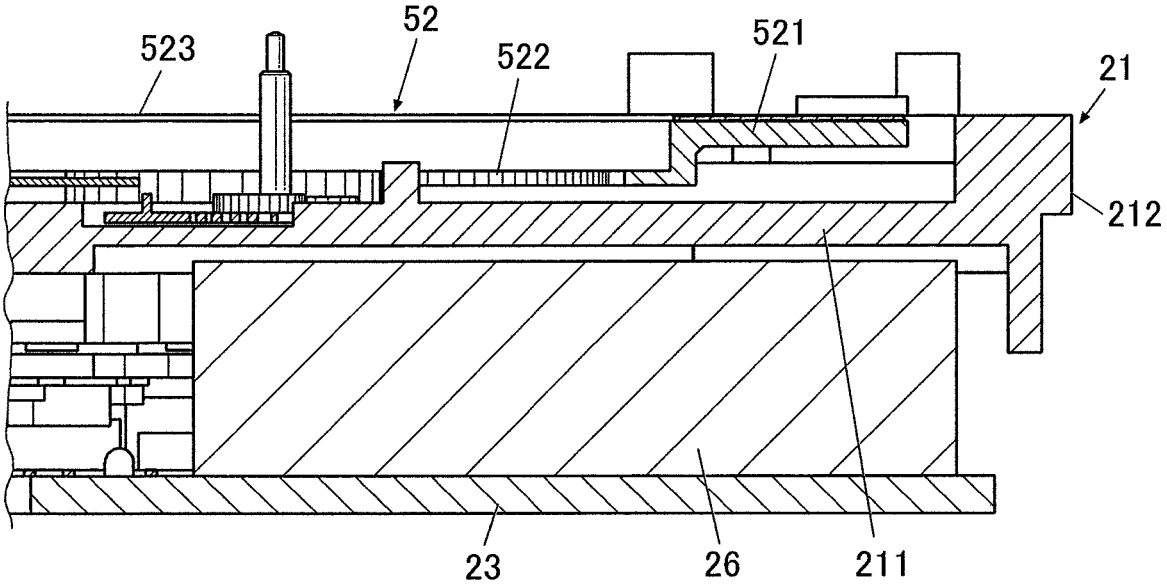
FIG. 11 is a cross-sectional view of the module taken along line XI-XI of FIG. 10.
Figure 12:
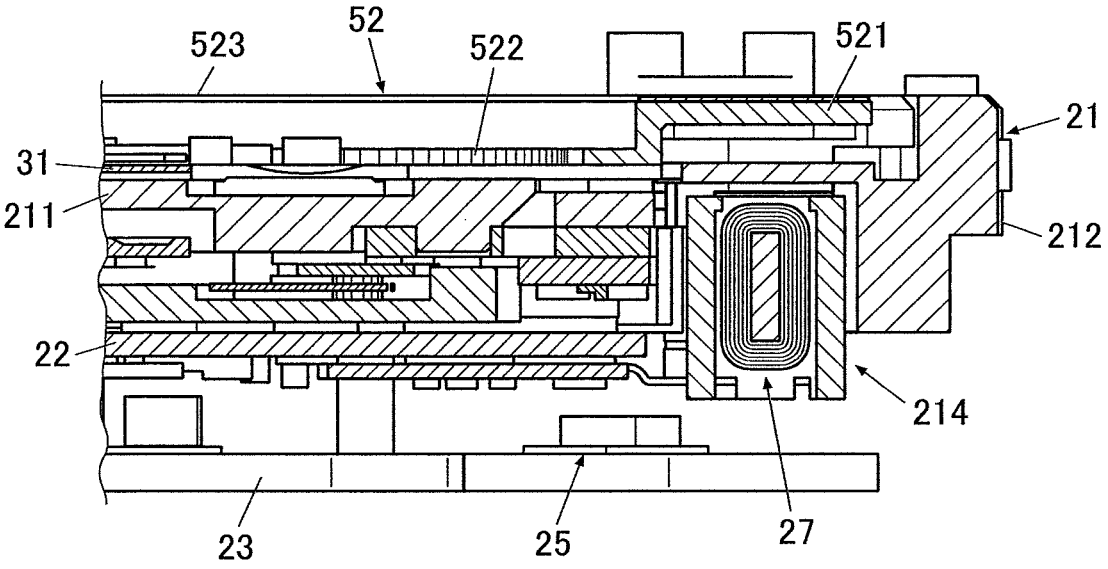
FIG. 12 is a cross-sectional view of the module taken along line XII-XII of FIG. 10.

FIG. 11 is a fragmentary cross-sectional view taken along line XI of FIG. 10. FIG. 12 is a fragmentary cross-sectional view taken along line XII of FIG. 10.

Figure 15:
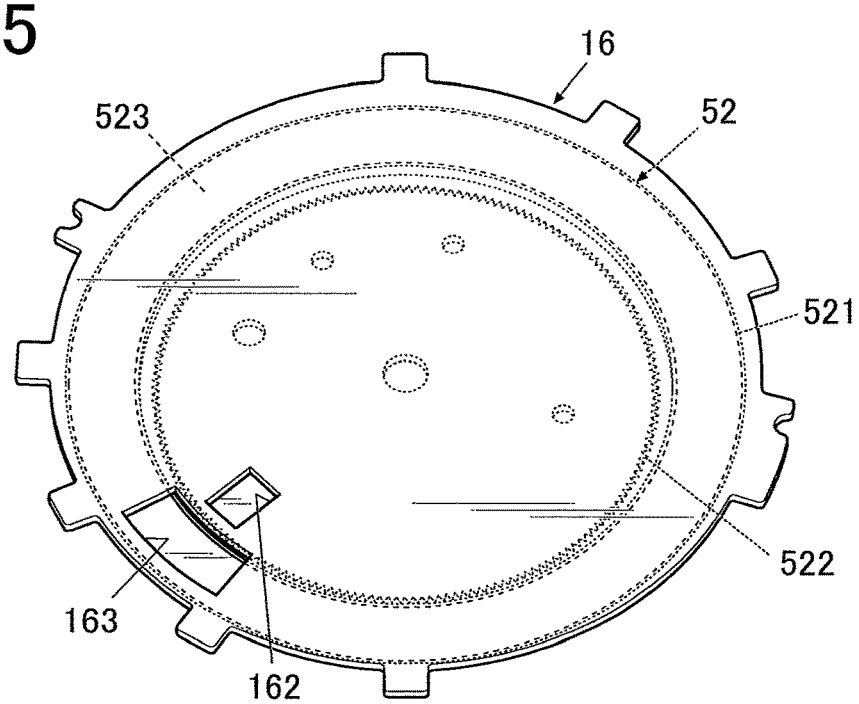
FIG. 15 is a perspective view illustrating a positional relationship between the functional wheel (a rotor) and a dial plate.

The calendar wheel 51 and the functional wheel 52, which are rotors, are disposed on the opposite (lower) side of the viewer of the dial plate 16, a decorative board partially equipped with the windows 162 and 163 (see FIG. 15).

Since only the functional wheel 52 according to this embodiment is a rotor having a characteristic configuration, the calendar wheel 51 is not shown in FIGS. 10 to 12.

With reference to FIG. 9, the functional wheel 52 according to this embodiment is disposed outer than the calendar wheel 51 in the plane direction along the inside face of the side wall 212 of the housing 21.

With reference to FIGS. 10 to 12, the functional wheel 52 is disposed to cover about half the GPS antenna 26 (see FIGS. 10 and 11) and substantially all the BLE antenna 25 and the standard radio wave antenna 27 (see FIGS. 10 and 12) in plan view.

Figure 13:
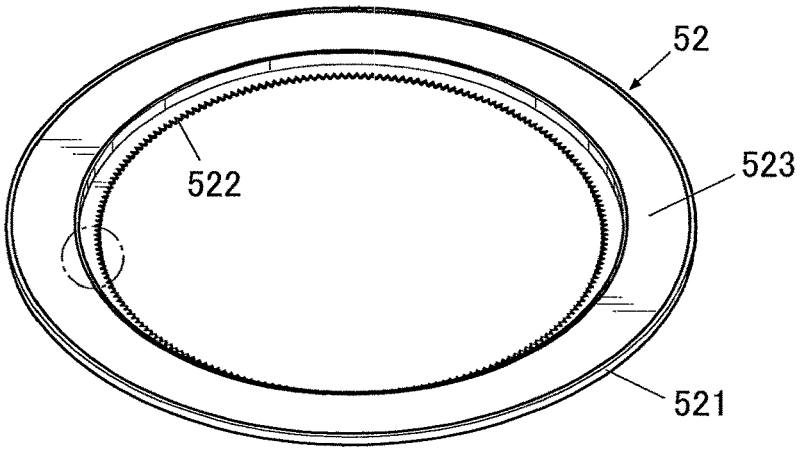
FIG. 13 is a perspective view of a functional wheel as a rotor.
Figure 14:
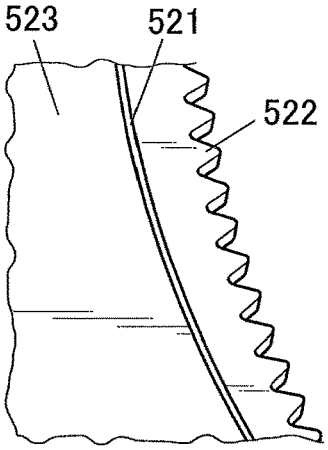
FIG. 14 is an enlarged view of an area encircled by a dot-and-dash line of FIG. 13.

FIG. 13 is a perspective view of the functional wheel 52 according to this embodiment. FIG. 14 is an enlarged perspective view of an area enclosed by a dot-and-dash line in FIG. 13.

FIG. 15 is a fragmentary perspective view illustrating a positional relationship between the functional wheel 52 and the dial plate 16.

As shown in FIGS. 13 and 14, the functional wheel 52 includes a toroidal wheel body 521 and a sawtooth gear 522 disposed on the inner periphery of the wheel body 521.

The gear 522 of the functional wheel 52 engages with the train wheel mechanism 29 and is connected to the motors 28 via the train wheel mechanism 29. When driven by the motors 28, the gear 522, which engages with the train wheel mechanism 29, rotates to cause the entire functional wheel 52 to rotate along the plane direction.

The functional wheel 52, being a rotor, has a metallic portion 523 on the upper face (viewer side) of the wheel body 521.

The metallic portion 523 according to this embodiment is an evaporated- or sputtered metallic film.

The metallic portion 523 may be composed of various metals, for example, Au, Cr, Al, Pt, Ni, Pd and Rh.

The metallic portion 523 may be formed by any method capable of forming a metallic film other than those shown here. Ion plating may be used, for example.

The metallic portion 523 has a minimum film thickness required to express a metallic appearance to minimize the impact of metal components on the antenna devices. The film thickness is, for example, about 500 angstroms to 5000 angstroms, although it depends on the type of metal or a method of forming the metallic portion 523.

The metallic film, which is composed of metal, may cause a reduction in receiving sensitivity of the BLE antenna 25, the GPS antenna 26, and the standard radio wave antenna 27 according to this embodiment, if these are disposed in the vicinity of the antenna devices. The metallic portion 523 should be preferably smallest possible.

Accordingly, the metallic portion 523 is not provided on the lower (rear) side of the wheel body 521 (i.e., the opposite side of the viewer), which does not affect appearance.

If the gear 522 had a metal surface produced by evaporation, metallic flakes could fall into the timepiece case 1 due to friction during engagement of the gears. The gear 522 is not exposed to the outside. Accordingly, no metallic portion 523 is provided on the upper and lower faces of the gear 522.

The metallic portion 523 need not cover the entire wheel body 521 and should be provided on a portion exposed through the window 163 in the dial plate 16, which functions as a decorative board shown in FIG. 15. In other words, the metallic portion 523 should be sized to be slightly wider than the width of the window 163, depending on the size of the window 163.

The operations of the electronic devices according to this embodiment and the timepiece 100 will now be explained.

The timepiece 100 is assembled as follows: A predetermined number of motors 28 and the train wheel mechanism 29 connected thereto are mounted on the viewer side of the base plate 211 of the housing 21. The front antimagnetic plate 31, which fully or partially covers multiple motors 28 and is provided with cutouts at positions overlapping with the several antenna devices, is mounted to cover the front faces of the motors 28. The motors 28*a*, 28*b*, and 28*d* according to this embodiment are provided with the side covers 312 to cover the coil blocks 284; the bridges 313 are bent at about 90° to the opposite side of the viewer; and the side covers 312 are bent along the side faces of the coil blocks 284 of the motors 28*a*, 28*b*, and 28*d* so as to cover the side faces of the coil blocks 284.

The rear antimagnetic plate 32 is mounted on the opposite side of the viewer of the base plate 211 to fully or partially cover these motors 28 while avoiding overlap with several antenna devices.

The standard radio wave antenna 27 is mounted in the antenna retainer 214 on the opposite side of the viewer of the base plate 211.

The upper substrate 22 is mounted on the opposite side of the viewer of the base plate 211 such that the GPS antenna space 213 is aligned with the cutout 221.

The BLE antenna 25 and the GPS antenna 26 are mounted on a side, facing the opposite side of the viewer of the upper substrate 22, of the lower substrate 23. The mounted BLE antenna 25 substantially overlaps with the standard radio wave antenna 27. The GPS antenna 26 is mounted so as to be fit into the GPS antenna space 213 of the housing 21 and the cutout 221 of the upper substrate 22.

The lower substrate 23 is superimposed on the upper substrate 22, the GPS antenna 26 is fit into the GPS antenna space 213, and the battery 24 is placed in the battery space 231 of the lower substrate 23. The module 2 according to this embodiment is finished.

The calendar wheel 51 and the functional wheel 52 are mounted on the viewer side of the module 2 to finish the electronic device according to this embodiment.

The electronic device is mounted in the timepiece case 1, the rear lid 12 is closed to block the opening on the opposite side of the viewer of the timepiece case 1, and the display 15 including the dial plate 16 and the pointers 17 is placed on the calendar wheel 51 and the functional wheel 52 in the electronic device.

The wind shield 11 is mounted on the opening on the viewer side of the timepiece case 1.

The assembly of the timepiece 100 according to this embodiment is finished.

An external magnetic field enters the timepiece 100 and adversely affects the motors 28 to reduce their operating accuracy.

In this embodiment, the antimagnetic plates are provided to fully or partially cover the motors 28 on the upper (viewer) sides and the lower sides (i.e., the opposite side of the viewer) of the motors 28. In other words, the motors 28 are disposed between the front antimagnetic plate 31, which is disposed on the upper sides of the motors 28, and the rear antimagnetic plate 32, which is disposed on the lower sides of the motors 28. This configuration allows the antimagnetic plates 31 and 32 to distort an external magnetic field to magnetically shield the motors 28 so that the magnetic field does not adversely affect the motors 28. For three motors 28*a*, 28*b* and 28*d* according to this embodiment, the side covers 312 connected to the antimagnetic plate body 311 also magnetically shield the side faces of the coil blocks 284. This configuration can achieve a higher antimagnetic effect.

In this embodiment, the substrate has a double-layer structure of the upper substrate 22 and the lower substrate 23, each of which has electronic components disposed thereon. This configuration enhances implementation efficiency.

The timepiece 100 according to this embodiment includes the functional wheel or rotor 52, which allows function-related information, such as city name, to appear through the window 163 provided on the dial plate 16.

The functional wheel or rotor 52 is disposed at a position fully or partially covering the BLE antenna 25, the GPS antenna 26, and the standard radio wave antenna 27 according to this embodiment. If the functional wheel 52 is disposed in a small timepiece case 1, like, for example, a wrist timepiece, the distance is short between the functional wheel 52 and the antenna devices.

However, the functional wheel 52, which is composed of a non-metallic material such as resin according to this embodiment, does not reduce the receiving sensitivity of the antenna devices.

The functional wheel 52 would lack a premium feel if it had a resin-like appearance since its top is partially exposed through the window 163. In this embodiment, the functional wheel 52 is provided with the metallic portion 523 of a metallic film on its upper face. This configuration provides the functional wheel 52 with a metal-look appearance when its top surface is partially exposed through the window 163.

As described above, the electronic device according to this embodiment and the timepiece 100 includes the BLE antenna 25, the GPS antenna 26, and the standard radio wave antenna 27, the motors 28*a* to 29*f*, and antimagnetic plates. The antimagnetic plates are disposed to fully or partially cover the multiple motors 28 and provided with the cutout 315 at positions overlapping with the BLE antenna 25, the GPS antenna 26, the standard radio wave antenna 27 according to this embodiment.

This configuration magnetically shields the motors 28 from an external magnetic field, which adversely affects the operation of the motors 28. With this, the external magnetic field does not reach the motors 28. This prevents malfunction of the motors 28, enhances their operating accuracy, and meet stringent antimagnetic requirements as set forth, for example, in Japanese industrial Standard (JIS) for antimagnetic timepieces.

In particular, the antimagnetic plate according to this embodiment includes the antimagnetic plate body 311 covering the viewer side of the motors 28 or opposite the viewer side. The antimagnetic plate may also include a side cover 312 connected to the antimagnetic plate body 311 to cover the side faces of the motors 28. This configuration also allows the antimagnetic plate to effectively shield the side faces of the motors 28.

This configuration can significantly reduce the impact of an external magnetic field on the motors 28 to the maximum extent possible and enhance antimagnetic performance.

An antimagnetic plate disposed in the vicinity of an antenna device may reduce the receiving sensitivity of the antenna device. However, the antimagnetic plates according to this embodiment are disposed to avoid the antenna devices. This configuration can retain the receiving sensitivity of the BLE antenna 25, the GPS antenna 26, and the standard radio wave antenna 27 according to this embodiment, while maintaining their antimagnetic performance.

The BLE antenna 25 and the standard radio wave antenna 27 according to this embodiment are at least partially superimposed in the thickness direction which is perpendicular to the plane direction of the antimagnetic plates. This configuration can reduce the implementation area of the antenna devices, downsize the entire timepiece, and save the space. This, in turn, decreases the range where the antimagnetic plates cannot be provided, increases a space for larger antimagnetic plates and further enhances the antimagnetic characteristics.

The antimagnetic plates according to this embodiment consist of the front antimagnetic plate 31 disposed on the viewer side of the timepiece 100 and the rear antimagnetic plate 32 disposed on the opposite side of the viewer. The motors 28 are disposed between the front antimagnetic plate 31 and the rear antimagnetic plate 32.

This configuration can efficiently eliminate the impact of an external magnetic field on the motors 28 to further enhance antimagnetic performance.

The timepiece 100 according to this embodiment includes the functional wheel 52 which displays function-related information, such as a city name. This expands the functionality of the timepiece 100.

The functional wheel 52, which is composed of a non-metallic material, such as resin, does not adversely affect the receiving sensitivity of the antenna devices.

The functional wheel 52 has the metallic portion 523, which has a metal-like appearance on its top. This provides a high-class appearance as if it could be achieved by a functional wheel 52 made of metal, while maintaining the receiving sensitivity of the antenna devices.

Although the embodiment of the present invention has been described above, it should be understood that the embodiment described above is not construed to limit the present invention and can be appropriately modified without departing from the scope of the present invention.

In the above embodiment, the exemplary multiple antenna devices, for example, include the BLE antenna 25, the GPS antenna 26, and the standard radio wave antenna 27. Alternatively, the electronic device and the timepiece 100 may have any type of antenna devices.

For example, the antennas may be magnetic sensors, such as azimuth sensors, or other sensors.

The number of antennas is not limited to three. In other words, a plurality of antennas (e.g., two, four, or more antennas) may be provided.

In the above embodiment, the exemplary metallic portion 523 of the functional wheel or rotor 52 is composed of an evaporated metallic film. Alternatively, the metallic portion 523 need not be a metallic film.

For example, if the functional wheel or rotor 52 is fabricated with a die, the metallic portion 523 may be formed on the viewer side of the rotor using a die with a surface pattern of streaks or rays from the rising sun formed by metal working.

This method can also provide a functional wheel or rotor 52 with a metal-like appearance and a high-class finish.

The rotor may be patterned using a die with a surface pattern formed by surface machining and then subject to the surface treatment for forming a metallic film as described above.

This can further enhance metallic feeling.

In the above embodiment, only the functional wheel 52 is provided with the metallic portion 523. Alternatively, for example, the calendar wheel 51 may be provided with a metallic portion.

The unexposed portions viewed through the windows 162 and 163 of the functional wheel 52 and the calendar wheel 51 does not need the metallic portion 523. In this case, the functional wheel 52 and the calendar wheel 51 should be rotated such that the portions without the metallic portion 523 overlap with the antenna devices while the antenna devices are receiving radio waves. This can maintain high receiving sensitivity of the antenna devices and further reduce the impact on the antenna devices.

In the above embodiment, the exemplary functional wheel or rotor 52 is substantially toroidal. Alternatively, the rotor may have any other shape that can rotate along the plane and are disposed to fully or partially cover the antenna devices in planar view. For example, the rotor may be a disk.

In the above embodiment, the electronic device is applied to the timepiece 100. The electronic device can also be applied to any apparatuses other than the timepiece 100. For example, the electronic device may be applied to a variety of apparatuses provided with antenna devices, such as GPS antennas, and motors.

For example, the electronic device according to the present invention may be applied to passometers, heart rate meters, altimeters, barometers, and terminals, such as mobile phones.

Although several embodiments of the present invention have been described above, the present invention should not be construed to limit the scope of these embodiments and includes the scope of the claims below or the equivalent thereto.

What is claimed is:

1. An electronic device comprising:

a plurality of antenna devices;

a plurality of motors; and antimagnetic plates, each antimagnetic plate at least partially covering at least one of the motors and having cutouts at positions overlapping with the antenna devices such that the antimagnetic plates do not overlap with the antenna devices, wherein a first antimagnetic plate among the antimagnetic plates comprises (i) an antimagnetic plate body disposed at one of a viewer side of the motors and a side of the motors opposite the viewer side, and (ii) a side cover that is integrated with and extends from the antimagnetic plate body, the side cover being disposed along and covering a side of coils of at least one of the plurality of motors.

2. The electronic device according to claim 1, wherein a second antimagnetic plate among the antimagnetic plates comprises an antimagnetic plate body disposed at the other one of the viewer side of the motors and the side of the motors opposite the viewer side.

3. The electronic device according to claim 2, wherein the side cover is disposed along and covers sides of the coils of motors, from among the plurality of motors, which are disposed near a periphery of a module.

4. The electronic device according to claim 1, wherein at least some of the antenna devices are at least partially superimposed in a thickness direction which is a direction perpendicular to a plane direction of the antimagnetic plates.

5. The electronic device according to claim 2, wherein at least some of the antenna devices are at least partially superimposed in a thickness direction which is a direction perpendicular to a plane direction of the antimagnetic plates.

6. The electronic device according to claim 3, wherein at least some of the antenna devices are at least partially superimposed in a thickness direction which is a direction perpendicular to a plane direction of the antimagnetic plates.

7. The electronic device according to claim 2, wherein the motors are disposed between the first antimagnetic plate and the second antimagnetic plate.

8. The electronic device according to claim 3, wherein the motors are disposed between the first antimagnetic plate and the second antimagnetic plate.

9. The electronic device according to claim 5, wherein the motors are disposed between the first antimagnetic plate and the second antimagnetic plate.

10. The electronic device according to claim 6, wherein the motors are disposed between the front antimagnetic plate and the rear antimagnetic plate.

11. A timepiece, comprising:

the electronic device according to claim 1;

a display displaying the time; and a case accommodating the electronic device and the display.

12. A timepiece, comprising:

the electronic device according to claim 2;

a display displaying the time; and a case accommodating the electronic device and the display.

13. A timepiece, comprising:

the electronic device according to claim 3;

a display displaying the time; and a case accommodating the electronic device and the display.

14. A timepiece, comprising:

the electronic device according to claim 4;

a display displaying the time; and a case accommodating the electronic device and the display.

15. A timepiece, comprising:

the electronic device according to claim 5;

a display displaying the time; and a case accommodating the electronic device and the display.

16. A timepiece, comprising:

the electronic device according to claim 6;

a display displaying the time; and a case accommodating the electronic device and the display.

17. A timepiece, comprising:

the electronic device according to claim 7;

a display displaying the time; and a case accommodating the electronic device and the display.

18. An electronic device comprising:

a plurality of antenna devices;

a plurality of motors; and antimagnetic plates, each antimagnetic plate at least partially covering at least one of the motors and having cutouts at positions overlapping with the antenna devices, wherein at least some of the antenna devices are at least partially superimposed in a thickness direction which is a direction perpendicular to a plane direction of the antimagnetic plates.

19. The electronic device according to claim 18, wherein the antimagnetic plates consist of a front antimagnetic plate disposed on a viewer side of the motors and a rear antimagnetic plate disposed on a side of the motors opposite the viewer side, and the motors are disposed between the front antimagnetic plate and the rear antimagnetic plate.

20. A timepiece, comprising:

the electronic device according to claim 18;

a display displaying the time; and a case accommodating the electronic device and the display.

* * * * *